United States Patent [19]

Robertson, Jr.

[11] 3,945,526

[45] Mar. 23, 1976

[54] CLOSURE CAP

[76] Inventor: Jack L. Robertson, Jr., 8231 Ellis Ave., Apt. 1C, Huntington Beach, Calif. 92627

[22] Filed: Feb. 26, 1975

[21] Appl. No.: 553,179

[52] U.S. Cl. ..... 215/302; 215/303

[51] Int. Cl.[2] ..... B65D 41/04

[58] Field of Search ..... 215/215, 302, 303, 305; 220/284, 260

[56] References Cited

UNITED STATES PATENTS

| | | | |
|---|---|---|---|
| 1,031,775 | 7/1912 | Cox | 215/303 |
| 1,036,893 | 8/1912 | Parker | 215/299 |
| 1,912,969 | 6/1933 | Carvalho | 215/302 |
| 2,308,217 | 1/1943 | Swanson | 215/303 |
| 3,653,530 | 4/1972 | Winfrey | 215/303 X |

*Primary Examiner*—Donald F. Norton

[57] ABSTRACT

A cap, which in addition to serving to removably seal a container, also acts as a carrier for torque-applying means that permit the cap to be released from a stuck position. The cap of the present invention is particularly well adapted for use on containers holding a lacquer based fingernail polish, although not restricted to such use. Caps on containers holding a lacquer base fingernail polish are notorious for tending to remain in a stuck position thereon, and to such an extent that pliers must be used to grip the cap and initially rotate the latter relative to the container on which it is mounted.

5 Claims, 7 Drawing Figures

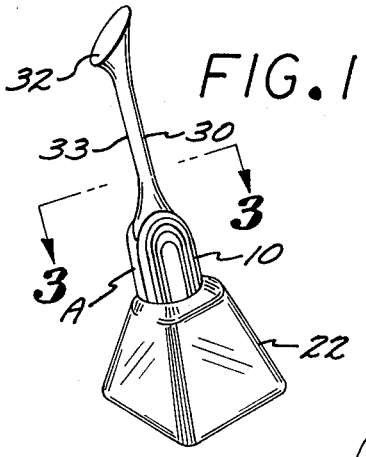
FIG. 1
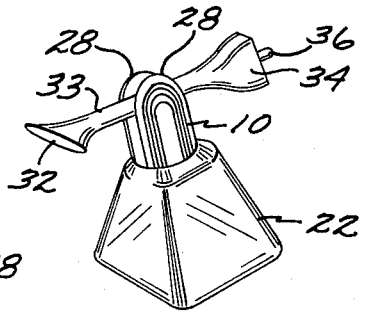
FIG. 2
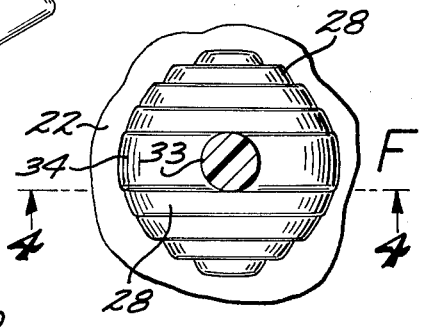
FIG. 3
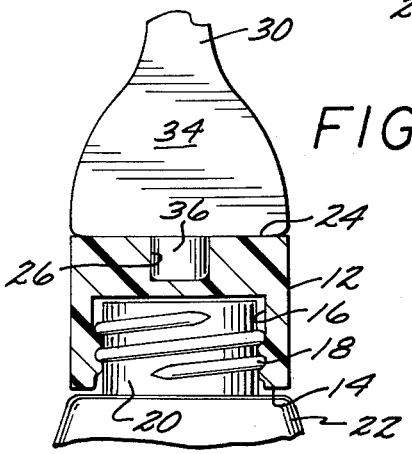
FIG. 4
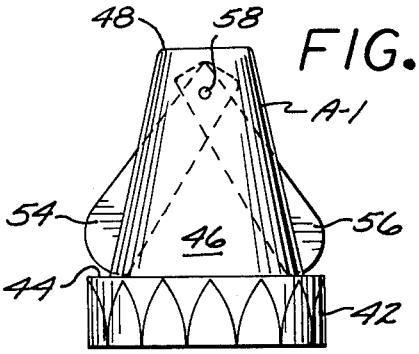
FIG. 5
FIG. 6
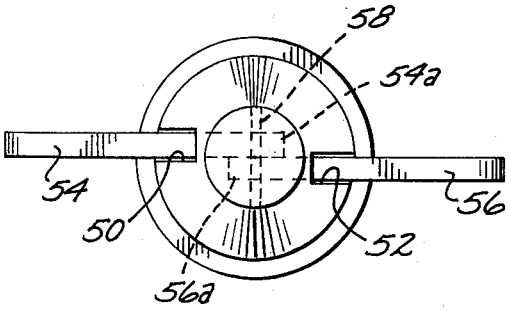
FIG. 7
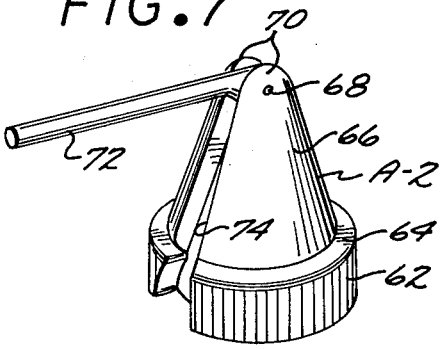

CLOSURE CAP

BACKGROUND OF THE INVENTION

1. Field of the Invention

Improved closure cap.

2. Description of the Prior Art

For many years it has been common practice to market lacquer based fingernail polish in containers having a threaded neck that is engaged by an internally threaded cap. After a cap on such a container is removed and replaced thereon, a quantity of the polish contents will invariably flow between the threads, with the volatile components thereof subsequently escaping to the ambient atmosphere. That portion of the polish remaining between the threads may range between tacky to a hard, rigid consistency. Regardless of the degree to which the polish between the threads solidifies, this portion of polish acts as a cement to bind the cap to the neck of the container. Caps such as above described are so small that it is difficult to grip them to the extent that they may be forcibly rotated relative to the necks on which they are mounted to break the bond of solidified polish between the threads.

A major object of the present invention is to provide a closure cap that not only serves as a seal on a container in which a quantity of a liquid lacquer based fingernail polish, or like material, is situated, but as a carrier for torque-applying means that permit a sufficient rotationally directed force to be applied to the cap to release it from a stuck position on a container.

Another object of the invention is to furnish a combined cap and torque-applying means which is susceptible to being formed from a polymerized resin, is easy to use, is of a simple mechanical structure, and is sufficiently inexpensive as to encourage the widespread use thereof.

SUMMARY OF THE INVENTION

A closure cap, which in addition to serving the normal function of sealing a container on which it is mounted, also serves as a carrier for torque-applying means that permit a sufficient rotational force to be applied to the cap to initially rotate it relative to the container on which the cap is mounted. By such initial rotation, the binding effect of a film of solidified material between the threads on the cap and neck of a container is broken, with the cap thereafter being easily unscrewed from the container.

BRIEF DESCRIPTION OF THE DRAWING

FIG. 1 is a perspective view of one embodiment of the present invention;

FIG. 2 is a view like FIG. 1, but showing a portion of the present invention in a torque-applying relationship;

FIG. 3 is a cross-sectional view of the embodiment of FIG. 1, taken along line 3—3 thereof;

FIG. 4 is a fragmentary longitudinal cross-sectional view of the embodiment of FIG. 3, taken along line 4—4 thereof;

FIG. 5 is a side elevational view of an alternate form of the present invention;

FIG. 6 is a top plan view of the embodiment of FIG. 5, but showing portions of the alternate form in a torque-applying relationship; and FIG. 7 is a perspective view of a second alternate form of the present invention.

DESCRIPTION OF THE PREFERRED EMBODIMENTS

A first embodiment A of the present improved closure member is shown in FIGS. 1-4 of the drawing, and includes a cap or closure 10, and a cap or closure remover 30. Cap or closure 10 as illustrated, includes a base portion 12 that has a bottom 14 from which an internally threaded recess 16 extends upwardly. Recess 16 engages threads 18 on a neck 20 of a container 22, which container may be of any desired shape. Base portion 12 includes an upper flat central surface 24 in which a cavity 26 extends downwardly therefrom, as shown in FIG. 4. Upper central surface 24 is situated between two laterally spaced uprights 28, as best seen in FIG. 2. The uprights 28 are adapted to receive a torque-applying cap remover 30 therebetween.

Cap remover 30 is elongate in shape and includes a first end portion 32 that may be of any desired ornamental configuration, a mid-portion 33, and a second end portion 34. The second end portion 34 is flat and tapered in configuration, and is of such thickness as to fit snugly between uprights 28 when it is slid therebetween. Second end portion 34 has a pin 36 projecting outwardly therefrom which engages cavity 26 when the remover 30 is disposed on cap 10, as shown in FIG. 4.

When the cap remover 30 is not in use it is removably supported on the cap 10, as shown in FIGS. 1 and 4, with the second end portion 34 being disposed between uprights 28, and the pin 36 in cavity 26. When it is desired to remove the cap 10 from container 22, the remover 30 is withdrawn from the cap, and disposed in the transverse position illustrated in FIG. 2 where the intermediate portion 33 is situated between uprights 28. First and second end portions 32 and 34 may then be grasped by one hand of the user, while his other hand grasps container 32. When the user applies a twistingly directed force to the remover 30, sufficient torque may be applied to the cap 10 to cause it to rotate relative to the neck 20 of container 22. After the initial twisting, any bond by a film of a lacquer based fingernail polish (not shown) between the engaging threads on the neck 20 and cap 10 is broken, and the cap may thereafter be easily unscrewed from the container 22.

After the remover 30 has been used as above described, it may be replaced on the cap 10 in the position shown in FIG. 1.

A first alternate form A-1 of the cap is shown in FIGS. 5 and 6 that includes a base portion 42 that is adapted internally to engage an externally threaded neck 20 of a container 22 in the same manner as cap A. Base portion 42 has a ring-shaped surface 44 from which a frusto-conical portion 46 extends upwardly. Portion 46 is provided with a top 48. First and second oppositely disposed, laterally off-set slots 50 and 52 extend downwardly into portion 46 from positions adjacent top 48 thereof, as shown in FIG. 6.

First and second arms 54 and 56 are provided that are partially disposed in first and second slots 50 and 52 when occupying first positions, as shown in FIG. 5. First and second arms 54 and 56 have adjacently disposed inner portions **54*a* and 56*a*, as may be seen in FIG. 6, which are pivotally mounted on a transverse portion 58**.

When it is desired to use the first and second arms 54 and 56 to apply torque to the first alternate form A-1 of the cap, the arms are pivoted from the first position shown in FIG. 5 to the second position illustrated in FIG. 6. When so positioned, the arms 54 and 56 are used to apply torque to the cap A-1 in the same manner as remover 30 was used to apply torque to cap 10.

A second alternate form A-2 of the closure is shown in FIG. 7 that includes an internally threaded cap 60 which has a base portion 62 that may be manually gripped to rotate the cap relative to the neck of the bottle (not shown) on which it is mounted. Base portion 62 has a ring-shaped upper surface 64 from which a tapered body 66 extends upwardly. At the top of body 66 it develops into two laterally spaced uprights 70 that have a transverse pin 68 extending therebetween that pivotally supports an arm 72. The arm 72 when pivoted outwardly as shown in FIG. 7 may be used to apply torque to the cap 60 to release the latter from a stuck position on a neck of a bottle. When arm 72 is not in use it is pivoted into the confines of a downwardly extending recess 74 formed in body 66 and base portion 62.

The use and operation of the various forms of the invention has been explained previously in detail and need not be repeated.

I claim:

1. A cap of the type that may be rotated into sealing engagement with an open portion of a container, said cap being characterized by including manually actuated torque applying means as a part thereof to permit sufficient rotationally directed force to said cap to release the latter from a stuck position on said container in which said torque applying means includes:

a. two laterally spaced uprights that extend upwardly from said cap;

b. an elongate rigid member having first and second ends; and c. means for removably supporting said member from said cap in a first position substantially parallel to said uprights, with said member capable of being removed from said first position and disposed in a second transverse position where a portion of said member intermediate said first and second ends is disposed between said uprights to permit torque to be applied to said cap to release the latter from a stuck position on said container.

2. A cap as defined in claim 1 in which said means is a pin that extends outwardly from said second end of said member and slidably engages a cavity in said cap situated between said uprights.

3. A cap of the type that may be rotated into sealing engagement with an open portion of a container, said cap being characterized by including manually actuated torque applying means as a part thereof to permit sufficient rotationally directed force to said cap to release the latter from a stuck position on said container, in which said torque applying means includes:

a. two elongate arms having first and second ends; and b. means for pivotally connecting said first ends of said arms to said cap, said arms when in first positions being at least partially disposed in slots formed in said cap, and said arms when in second positions being oppositely disposed and transversely positioned relative to said cap to permit rotational torque to be manually applied to said cap to release the latter from a stuck position on said container.

4. A cap as defined in claim 3 in which said means includes:

c. a pin that extends transversely through said cap and pivotally supports said first ends of said arms.

5. A cap of the type that may be rotated into sealing engagement with an open portion of a container, said cap being characterized by including manually actuated torque applying means as a part thereof to permit sufficient rotationally directed force to said cap to release the latter from a stuck position on said container, in which said torque applying means includes:

a. two laterally spaced uprights that extend outwardly from said cap;

b. a pin that extends transversely between said uprights; and c. an arm having first and second ends, said first end pivotally supported from said pin, said arm when in a first position being at least partially disposed in a slot formed in said cap, and said arm when in a second position transversely disposed relative to said cap to permit rotational torque to be applied to said cap to release said cap from a stuck position on said container.

* * * * *